United States Patent [19]

Johnson

[11] Patent Number: 4,703,812

[45] Date of Patent: Nov. 3, 1987

[54] MOBILE DRILLING APPARATUS

[75] Inventor: Clarence W. Johnson, Calgary, Canada

[73] Assignee: Bralorne Resources Limited, Calgary, Canada

[21] Appl. No.: 545,197

[22] Filed: Oct. 25, 1983

[30] Foreign Application Priority Data

Jan. 11, 1983 [CA] Canada ..... 422153

[51] Int. Cl.[4] ..... E21B 3/02

[52] U.S. Cl. ..... 173/152; 173/28

[58] Field of Search ..... 173/28, 152, 22, 81, 173/141, 34, 150; 408/129, 130; 175/203, 162; 92/52, 53

[56] References Cited

U.S. PATENT DOCUMENTS 3,131,776 5/1964 Aune et al. ..... 175/162
3,228,487 1/1966 Failing ..... 173/152
3,282,357 11/1966 Bunn ..... 175/162
3,814,194 6/1974 Reich et al. ..... 173/28
3,958,376 5/1976 Campbell ..... 92/53

*Primary Examiner*—E. R. Kazenske
*Assistant Examiner*—James L. Wolfe
*Attorney, Agent, or Firm*—John R. Uren

[57] ABSTRACT

A mobile drilling apparatus having a support structure, a mast positioned on the support structure, a drill head and a hydraulic assembly vertically operable on and guided by the mast. The hydraulic assembly moves the drill head and includes lower hydraulic cylinders rigidly connected to the mast and upper cylinders, each mounted inside and connected rigidly to a tube. A piston rod with connected upper and lower pistons is movable within the upper and lower hydraulic cylinders. The drill head is connected to the lower portion of the tube.

12 Claims, 6 Drawing Figures

MOBILE DRILLING APPARATUS

INTRODUCTION

This application relates to a drilling apparatus and, in particular, to a mobile drilling apparatus used to drill medium depth wells.

BACKGROUND OF THE INVENTION

Drill rigs can be large and complicated. For the transportation of rigs used to drill deep wells, several days may be necessary to load the rig and many large trucks may be needed to move it. These large drill rigs, however, are not necessary for medium or shallow depth well drilling, say in the range of 5000 ft. maximum depth. For wells of such depth, a rig of more simple design can be used which results in a lighter, more mobile unit.

Those rigs classified as medium depth mobile drill rigs utilize one or more hydraulic cylinders to raise and lower the drilling pipe and may be divided into two basic design types. The most common design type utilizes flexible steel chains or cables operating over sprockets, rollers or sheaves to connect the movable part of the hydraulic cylinders to a drill head guided by the mast of the rig. The drill head is thus indirectly moved up or down in a vertical track by the extension or retraction forces provided by the hydraulic cylinder and chain operable system.

The less common drill design type connects the moving part of the hydraulic cylinder system directly to the drill head or, alternatively, it may use a tube in which the cylinder system is mounted. In these designs, the cylinders are mounted adjacent to the path of movement of the drill head and it is customary to utilize the extension forces of the cylinders to provide the necessary vertical hoisting movement. The cylinder system therefore acts as a column on which is imposed an axial compressive load. Because the load capacity of a column of given length is dependent upon it being constrained in a straight line to prevent buckling, the hoisting capacity and stroke of the rig are dependent on the mounting and guidance of the hydraulic column system.

In these prior direct acting rig designs, the cylinder systems utilized to move the drill head have disadvantages. A first problem relates to the stability of the cylinder system. In one configuration, the piston rod of the lower hydraulic cylinder is connected to the bottom end of the mast. The hydraulic cylinder moves vertically relative to the piston rod and the upper piston rod moves vertically relative to the hydraulic cylinder. With an arrangement of this nature, the hydraulic system column cannot be rigidly connected to the mast at any other point due to the relative motion of the components making up the column. Further, the lower piston rod is necessarily exposed to the elements and various rig operations. Since seals must isolate the rod from the cylinder, naturally resulting mechanical damage, dirt, corrosion, etc., can adversely affect the seal integrity.

A further problem is the unnecessarily large cross-sectional area of the tube. It is advantageous, because the tube is raised and is in the air, to have a minimal cross-sectional tube area to reduce its weight. When the piston rod is rigidly connected to the mast, the centrally located cylinder must be movable relative to the tube and return hydraulic lines must be positioned outside the cylinder. The tube, in turn, must be large enough to accomodate the moving return lines in addition to the hydraulic cylinder.

Yet a further problem relates to the couplings between the mast, piston rod, cylinder and tube. In present rigs, the drill head is connected to the tube but since the tube moves relative to the cylinder, guidance of the cylinder center point is dependent on guidance of the tube. Two concentric supports, each necessarily having an accompanying tolerance, are required. This results in unavoidable tolerance buildup thereby reducing the rigidity and hence the column strength of the hydraulic assembly.

SUMMARY OF THE INVENTION

According to one aspect of the present invention, there is disclosed a drill assembly comprising a mobile support means, a mast positioned on said support means, a reciprocally operable drill head, a hydraulic cylinder system supported by said mast and operable to move said drill head, said system comprising a lower hydraulic cylinder rigidly connected to said mast, an upper cylinder movable relative to said mast, a lower piston movable within said lower hydraulic cylinder, an upper piston movable within said upper cylinder, a piston rod connected to said lower and upper pistons and a tube surrounding said upper cylinder and connected thereto, said drill head being connected to the lower portion of said tube.

BRIEF DESCRIPTION OF THE SEVERAL VIEWS OF THE DRAWINGS

In drawings, which illustrate an embodiment of the invention.

DESCRIPTION OF SPECIFIC EMBODIMENT

Figure 1:
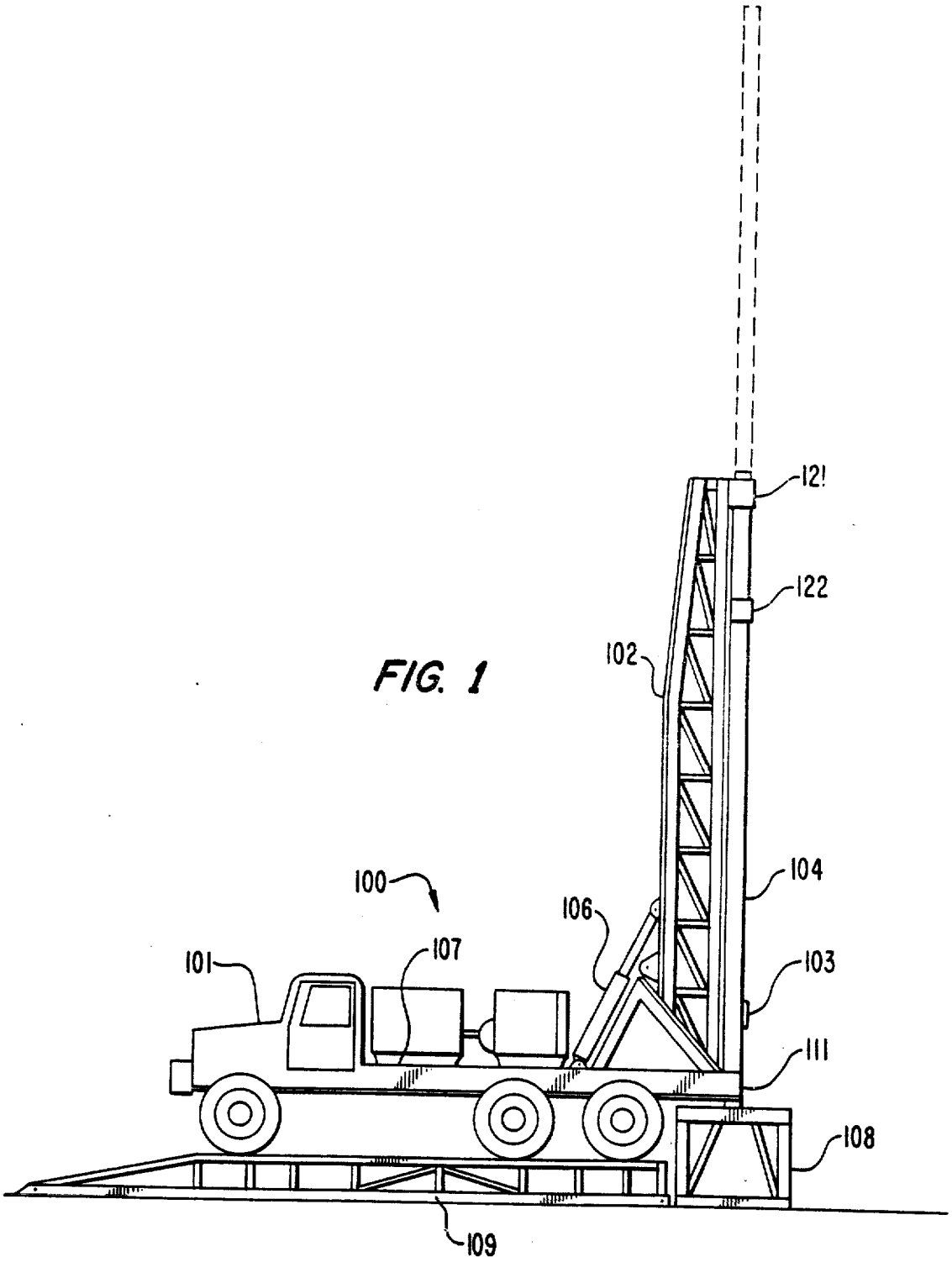
FIG. 1 is a side view showing a mobile drill rig in operating position.

A mobile drilling rig is generally shown at 100 in FIG. 1. It comprises a truck 101 which transports the equipment, a movable mast generally shown at 102 which supports the drill head 103 and its accompanying hydraulic cylinder assemblies 104, 105. Mast 102 is pivotably mounted on the truck 101 and is raised to operating position by the use of hydraulic cylinder 106. After the mast 102 is raised to its operating position, it is supported by an extension 111 of frame 107 and a rigid support structure 108 which is positioned below the mast 102. A ramp 109 is used to raise the mobile drill rig 100 into operating position.

Figure 2:
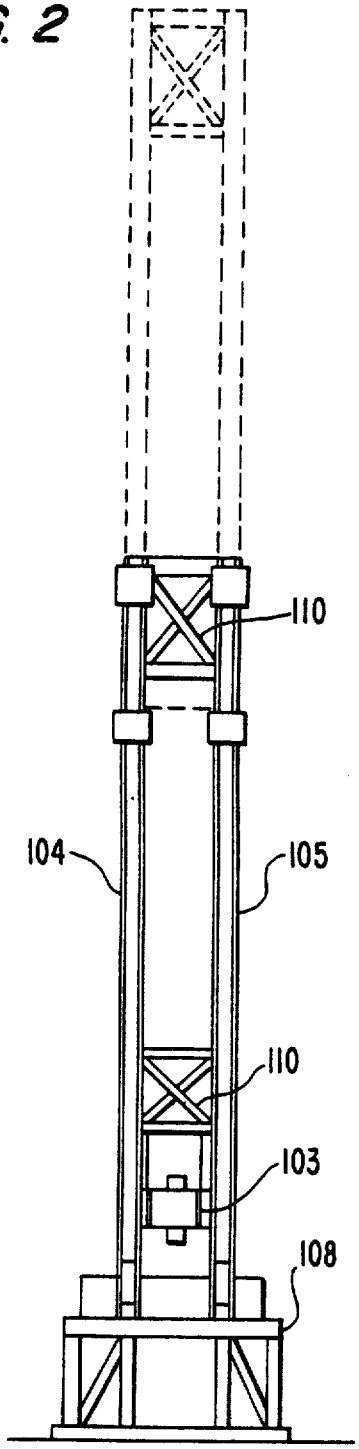
FIG. 2 is a rear view of the drill rig of FIG. 1.

Referring to FIG. 2, the drill head 103 is supported between hydraulic assemblies 104, 105 which are connected together and supported laterally by cross bracing 110 and the mast 102. Drill steel (not shown) is turned by the drill head 103 and vertical forces are placed on the drill steel by the drill head 103 under the influence of hydraulic cylinder assemblies 104, 105. The hydraulic assemblies 104, 105 are supported axially by the cylinder support 111 and rigid support structure 108.

Since the two hydraulic assemblies 104, 105 are identical, only one will be further described.

Figure 3:
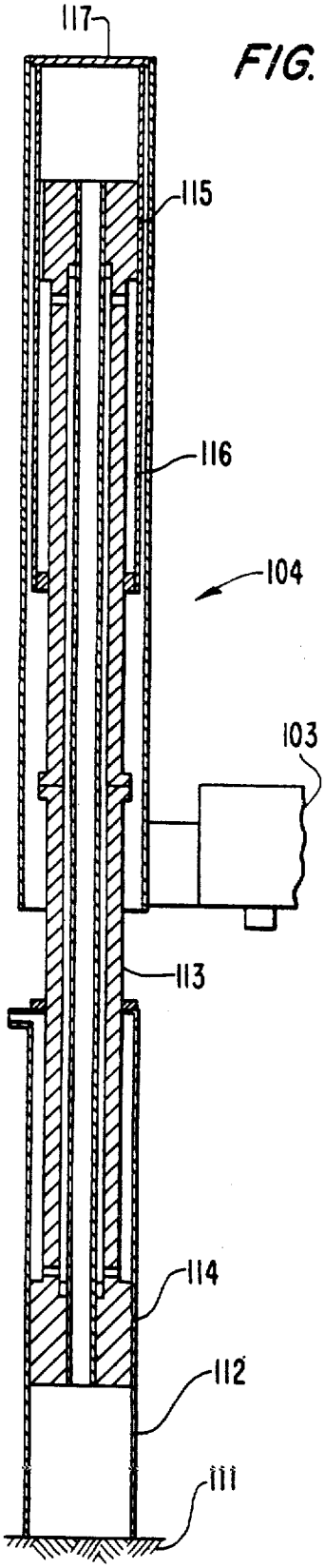
FIG. 3 is a cross-sectional cutaway view of one of the hydraulic cylinders showing the drill head in a partially raised position.
Figure 5:
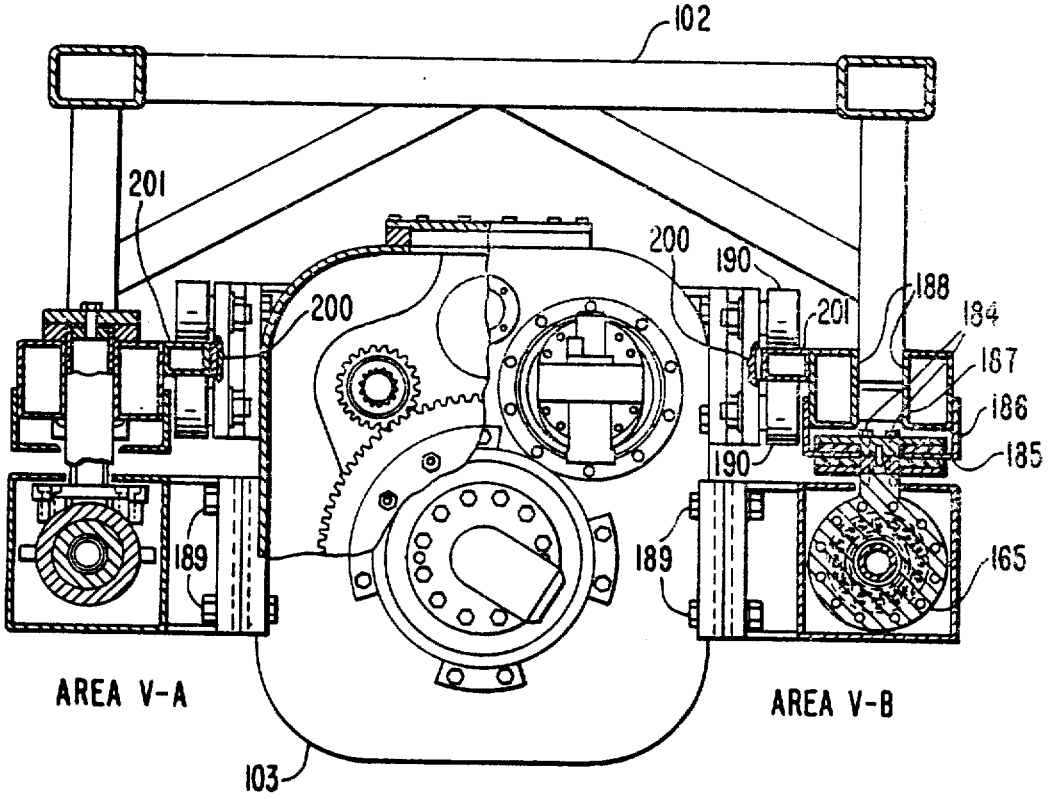
FIG. 5 is a plan and partial cutaway view of the mast and drill head of the drill rig with two views taken at VA—VA and VB—VB of FIG. 4.

As seen in FIG. 3, the hydraulic assembly 104 comprises four main components, namely a lower cylinder 112, a piston rod 13 with its associated lower and upper pistons 114, 115, respectively, an upper cylinder 116 surrounding the upper portion of the piston rod 113 and upper piston 115 and a pull tube 117 rigidly connected to upper cylinder 116. Drill head 103 is rigidly connected to pull tube 117 as shown in FIGS. 3 and 5 and lower cylinder 112 is rigidly connected to the mast 102 which, in turn, is supported by frame extension 111. Frame extension 111 is, in turn, supported by support structure 108. Jacks (not shown) are used to take up any play between the support structure 108 and the frame extension 111. Tube guides 121, 122 provide guidance and restraint for pull tube 117.

The hydraulic cylinder assembly 104 is more clearly seen in FIG. 4 and will be described in detail. It comprises lower cylinder 112, piston rod 113, upper cylinder 116 and pull tube 17. Lower and upper pistons 114, 115, respectively, are positioned on opposite ends of piston rod 113.

Lower cylinder 112 is welded to a lower end fitting 118 and this fitting 118 is rigidly connected to the mast 111 by the use of bolts 119. A passage 120 is machined in lower end fitting 118 to allow for the passage of hydraulic fluid into lower cylinder 112.

At the upper end of lower cylinder 112 and the lower end of upper cylinder 116 are ported bosses 130, 131, respectively, each fitted with threaded holes to which flanges 132, 133, respectively, can be attached by means of bolts 134.

The flange 132 of lower cylinder 112 is connected to a tube 135 carrying hydraulic fluid. The blind flange 133 of upper cylinder 116 blocks ported boss 131.

The upper end of lower cylinder 112 is rigidly attached to the mast structure by bracket 136 and bolts 137, 138. A slot 139 is provided in pull tube 117 to accomodate bracket 136 and tube 135 such that pull tube 117 is free to reciprocate vertically with upper cylinder 116. The lower end of upper cylinder 116 is attached to the pull tube 117 at boss 140 by bolts 150.

The upper end of lower cylinder 112 and the lower end of upper cylinder 116 are each fitted with threaded end closures 151, 152 and are machined identically.

Each threaded end closure 151, 152 contains rod wipers 153 to remove foreign material from the piston rod 113, rod seals 154, rod guide bushings 155 closely fitted to the piston rod 113, passage holes 156 and an annular recess 157. The open end bore 158 of end closures 151, 152 is closely fitted to the enlarged diameter 159 of the piston rod 113.

Annular grooves 160 are machined into the inside of each cylinder wall in line with the opening in ported bosses 130, 131 and act to allow the passage of hydraulic oil from ported boss 130 through passage holes 156 and thence to annular recess 157.

In order to provide for interchangeable parts, there has been an intention to provide identical top and bottom components in each hydraulic assembly wherever possible. To that end, piston rod 113 comprises a lower section and an upper section 161, 162 respectively. The lower and upper sections 161, 162 are held concentric and in axial alignment by the mating cylindrical diameters of connectors 163, 164 and disc bracket 165.

Bolts 166 simultaneously clamp connectors 163, 164 and rod ends 167, 168 against the opposite faces of disc bracket 165 by acting on nuts 169, 170 threaded on the lower and upper sections 161, 162 of piston rod 113. Wedge rings 180, 181 may be contracted inwardly and expanded outwardly by tightening bolts 182 and thus effecting a rigid attachment between connectors 163, 164 and lower and upper sections 161, 162 of piston rod 113.

Seals 183 prevent hydraulic fluid leaks at the interface between lower and upper sections 161, 162 of piston rod 113 and disc bracket 165.

Referring to FIG. 5, disc bracket 165 is shown mounted by bolts 184 to piston rod connector guide shoe 185 which slides along the flanges of angles 186. Guide shoe 185 is further constrained by guide rollers 187 (see also FIG. 4) operating between the two mast members 188.

The attachment of the drill head 103 to the lower end of pull tube 117 is by means of bolts 189. The drill head 103 and attached lower end of tube 117 are guided by rollers 190 and guide pads 200 on guide rail 201.

An inner tube shown generally at 202 is disposed within the piston rod 113 and is adapted so as to leave a circumferential passage 203 between it and the inside of piston rod 113. It also comprises a lower and upper portion 204, 205, respectively. The lower and upper portions 204, 205 are welded to the ends of piston rod 113 thus preventing fluid passage and relative axial movement.

A collar 206 joins the upper and lower portions 204, 205 of inner tube 202. Seals 207 prevent hydraulic fluid leakage.

Lower and upper pistons 114, 115 respectively, are integral with lower and upper sections 161, 162, respectively, of piston rod 113. Both the lower and upper pistons 114, 115 are designed to closely slide within lower and upper cylinders 112, 116, respectively. Seals 208 mounted in pistons 114, 115 are adapted to seal the pistons 114, 115 from the end portions of lower and upper cylinders 112, 116 respectively.

The upper cylinder end fitting 209 is closed by blind flange 210. It is positioned in the centre of the upper end of the pull tube 117 by connector flange 211 and bolts 212. Collar ring 213 and bolts 214 attach end fitting 209 to connector flange 211. Thus the upper end of upper cylinder 116 is rigidly attached to the upper end of pull tube 117.

Two series of throttling passages 215, 216 are drilled through the lower and upper sections 161, 162 respectively and are located adjacent stops 217, 218.

OPERATION

In operation, it will be assumed the mobile drilling rig 100 is in the state depicted in FIG. 1. That is, the mast 102 will have been raised to its vertical operating position, the rigid support structure 108 is in place and the drill head 103 has been attached between each pull tube 117 of the hydraulic assemblies 104, 105 as shown in FIG. 2. The hydraulic assembly 104 is in its fully collapsed position as depicted in the solid lines of FIG. 1.

Figure 4A:
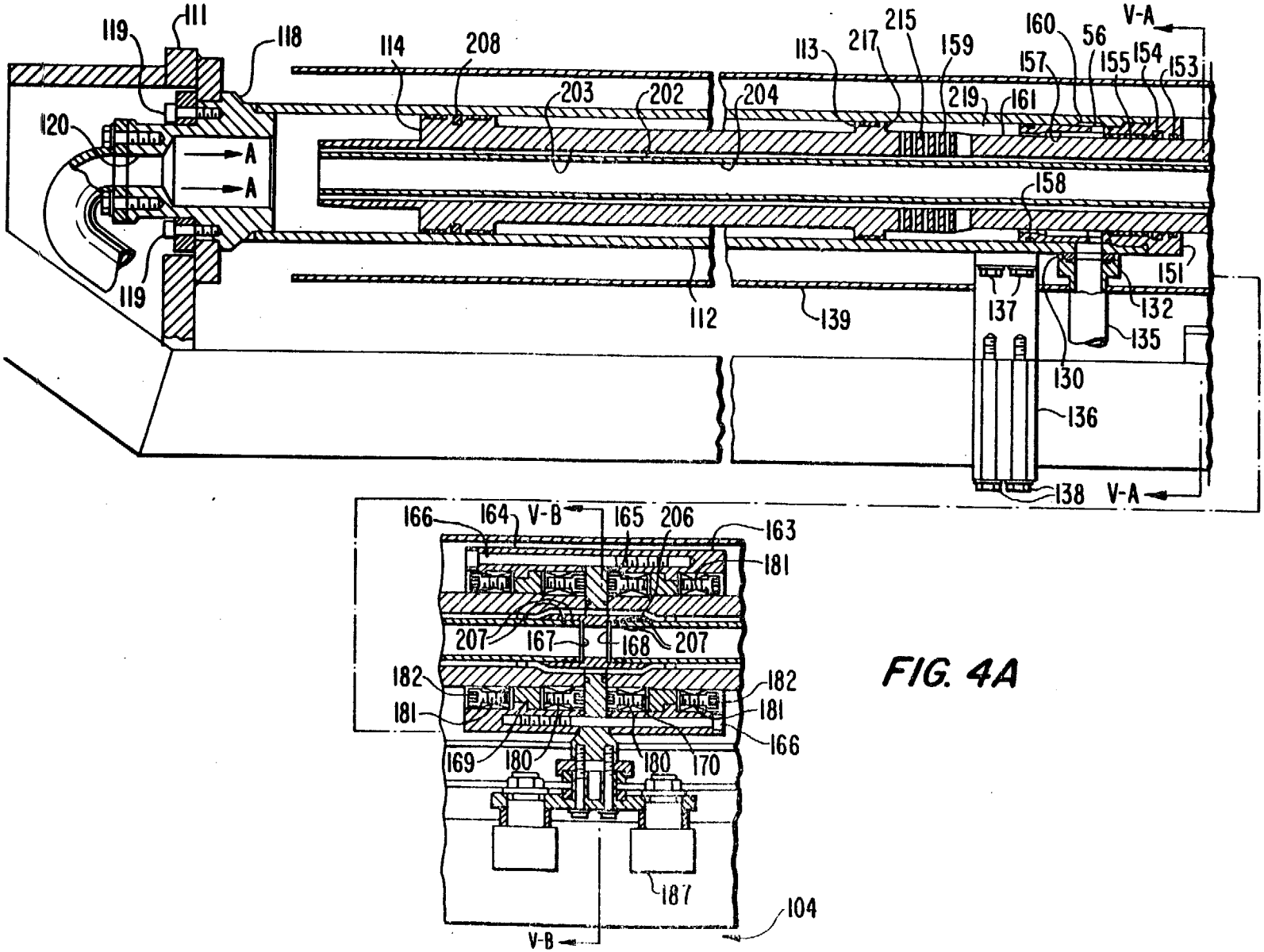
FIG. 4A is a partial cross-sectional enlarged cutaway view of the cylinder configuration in a partially retracted postion.
Figure 4B:
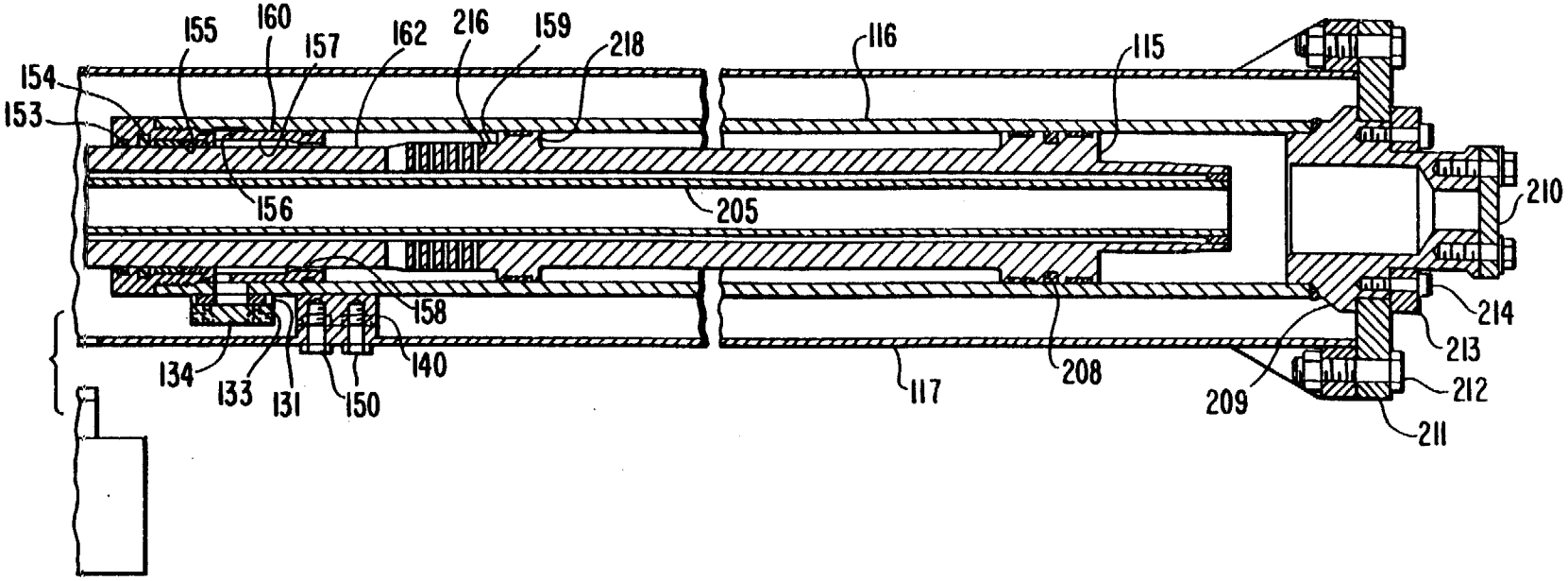
FIG. 4B is a continuation of the view described in FIG. 4A.

Referring to FIG. 4, the drill head is to be raised. Accordingly, hydraulic fluid will be pumped into the hydraulic assembly through the passage 120 in lower end fitting 118. As indicated by arrows A, the fluid will pass upwardly through inner tube 202 and will exert pressure across the area of upper end fitting 209. Fitting 209, which is attached to upper cylinder 116 and tube 117, will be forced upwardly carrying the drill head 103 as seen in FIG. 3.

Upper cylinder 116 together with drill head 103 and tube 117 will continue to move upwardly under the influence of the hydraulic fluid until the upper cylinder rod threaded end closure 152 contacts stop 218 (FIG. 4) on upper piston 115. At this point, upper piston 115, piston rod 113 and lower piston 114 will commence their upwards movement. This continues until stop 217 contacts lower cylinder rod end closure 151 which terminates any further upwards movement of the drill head 103. As the stops 217, 218 approach their abutment positions, the stopping impact will be cushioned by the throttling passages 215, 216 which are closed off, one after the other, thus gradually restricting the exit of hydraulic fluid.

When it is desired to move the drill head 103 downwardly, the fluid flow is reversed. Hydraulic fluid is pumped through tube 135 and passes through ported boss 130, groove 160, annular recess 157 and out of open end bore 158 into cavity 219 and acts downwardly on upper end of piston 114. Piston 114, together with piston rod 113 and piston 115 will continue to move downwardly bringing with them upper cylinder 116 and attached tube 117. This downwards movement will continue until lower piston 114 contacts lower end fitting 118. Thereafter, the fluid will act downwardly on upper cylinder rod end closure 152 and it, together with attached upper cylinder 116 and pull tube 117, will move downwardly until contact is made between the end of upper piston 115 and upper cylinder end fitting 209. At this point, the drill head 103 will be in its lowermost position.

While the specific embodiment described operates with the mast in a vertical position, the drill may also be used for angle drilling when the mast is at an angle to the horizontal. Similarly, the description is illustrative of only one embodiment of the invention and should not be construed as limiting the invention as many changes may be made without departing from the scope of the accompanying claims.

The embodiments of the invention in which an exclusive property or privilege is claimed are defined as follows:

1. A drill assembly comprising a mobile support means, a mast positioned on said support means, a reciprocally operable drill head, a hydraulic cylinder system supported by said mast and operable to move said drill head, said system comprising a lower hydraulic cylinder rigidly connected to said mast, an upper cylinder movable relative to said mast, a lower piston movable within said lower hydraulic cylinder, an upper piston movable within said upper cylinder, a piston rod conected to said lower and upper pistons and a tube surrounding said upper cylinder and connected thereto, said drill head being connected to a lower portion of said tube.

2. A drill assembly as in claim 1 hwerein said piskton rod comprises an upper and lower portion, said portions being connected at a central portion of said piston rod.

3. A drill assembly as in claim 2 wherein the upper portion of said lower cylinder is rigidly connected to said mast.

4. A drill assembly as in claim 3 wherein said tube is movably supported by said mast.

5. A drill assembly as in claim 4 and further comprising a source of hydraulic fluid to move said lower piston relative to said lower cylinder and said upper cylinder and tube relative to said upper piston.

6. A drill assembly as in claim 5 wherein said fluid passes through said lower piston, said piston rod and said upper piston and acts on said upper cylinder to raise said upper cylinder relative to said mast.

7. A drill assembly as in claim 6 wherein said lower piston is raised subsequent to said upper cylinder.

8. A drill assembly as in claim 6 wherein said drill head is attached between said tube of said hydraulic cylinder and a second tube of a further hydraulic cylinder, both of said cylinders being connected to said mast.

9. A drill assembly, said assembly comprising a mobile support means, a mast supported by said mobile support means, at least two hydraulic cylinders connected to said mast and located adjacent thereto, a drill head connected between said hydraulic cylinders, each of said cylinders comprising a lower cylinder rigidly connected to said mast, a lower piston movable within said lower cylinder, a piston rod connected to said lower piston, an upper cylinder, an upper piston movable within said upper cylinder and connected to the opposed end of said piston rod, a tube substantially surrounding said upper cylinder and rigidly connected thereto, said upper cylinder and said tube being movable relative to said piston, said drill head being attached between the tube of each respective cylinder.

10. A drill assembly as in claim 9 wherein said piston rod comprises lower and upper portions, said portions being connected at a central portion of said piston rod.

11. A drill assembly as in claim 10 wherein a upper portion of each of said lower cylinders is rigidly attached to said mast.

12. A drill assembly as in claim 11 wherein each of said tubes is movable within supports located near the upper portion of said mast.

* * * * *

UNITED STATES PATENT AND TRADEMARK OFFICE

CERTIFICATE OF CORRECTION

PATENT NO. : 4,703,812

DATED : November 3, 1987

INVENTOR(S) : Clarence W. Johnson

It is certified that error appears in the above-identified patent and that said Letters Patent is hereby corrected as shown below:

Column 3, line 24: change "17" to --117--.

Column 6, line 7: change "hwerein" to --wherein--; and change "piskton" to --piston--.

Signed and Sealed this

Nineteenth Day of April, 1988

*Attest:*

*Attesting Officer*

DONALD J. QUIGG

*Commissioner of Patents and Trademarks*